United States Patent [19]

Jones

[11] Patent Number: 4,966,303

[45] Date of Patent: Oct. 30, 1990

[54] INSULATED BEVERAGE CONTAINER SECUREMENT APPARATUS

[76] Inventor: August C. Jones, Rte. 3, Box 193, Eufaula, Okla. 74432

[21] Appl. No.: 390,975

[22] Filed: Aug. 7, 1989

[51] Int. Cl.[5] ..... B65D 25/14

[52] U.S. Cl. ..... 220/411; 215/13.1; 220/85 H; 220/94 R; 220/903

[58] Field of Search ..... 215/12.1, 13.1, 100 A, 215/100 R, 100.5; 220/85 H, 94 R, 410–413, 903; 248/311.2, 313

[56] References Cited

U.S. PATENT DOCUMENTS

| | | | |
|---|---|---|---|
| 3,013,691 | 12/1961 | Prentice . | |
| 3,302,427 | 2/1967 | Stoner et al. . | |
| 3,302,428 | 2/1967 | Stoner et al. . | |
| 3,633,863 | 1/1972 | Abbey | 220/903 |
| 4,006,852 | 2/1977 | Pilsner et al. | 224/42.45 R |
| 4,026,435 | 5/1977 | Hendon | 220/85 H |
| 4,629,153 | 12/1986 | Marcum | 220/85 H |
| 4,648,525 | 3/1987 | Henderson | 220/85 H |
| 4,671,424 | 6/1987 | Byrns | 220/85 H |
| 4,708,254 | 11/1987 | Byrns | 220/85 H |
| 4,720,023 | 1/1988 | Jeff . | |
| 4,746,028 | 5/1988 | Bogg . | |
| 4,754,902 | 7/1988 | Opfergelt | 224/148 |

FOREIGN PATENT DOCUMENTS

| | | | |
|---|---|---|---|
| 0141320 | 5/1951 | Australia | 220/94 R |

*Primary Examiner*—Jimmy G. Foster
*Attorney, Agent, or Firm*—Leon Gilden

[57] ABSTRACT

A securement apparatus is set forth for use in combination with an insulated styrofoam-type cut for receiving a beverage container therewithin. The apparatus utilizes a sleeve for surrounding relationship relative to the styrofoam-type cup with an upper and lower clamp securable about the sleeve to frictionally engage the sleeve relative to the cup with a handle member securable to the sleeve utilizing upper and lower clamps. An upper cap overlies the sleeve to receive the can therethrough.

8 Claims, 4 Drawing Sheets

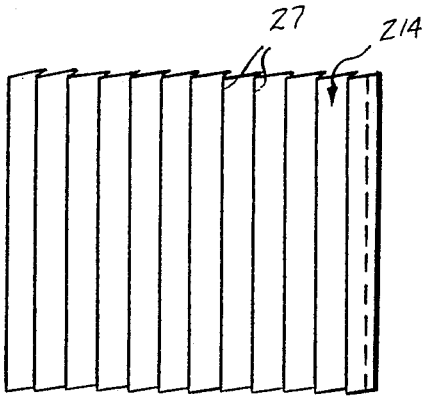
FIG 6
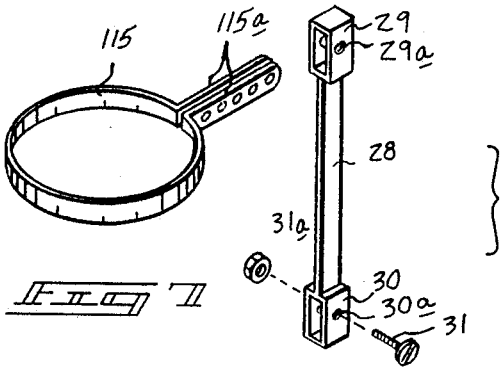
FIG 7
FIG 8
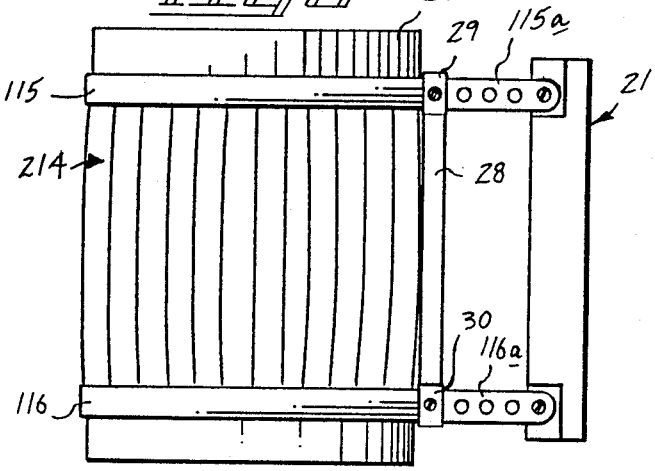

INSULATED BEVERAGE CONTAINER SECUREMENT APPARATUS

BACKGROUND OF THE INVENTION

1. Field of the Invention

The field of invention relates to insulated beverage container apparatus, and more particularly pertains to a new and improved insulated beverage container securement apparatus for the reception and securement of beverage containers within an insulated assembly.

2. Description of the Prior Art

Insulated beverage container apparatus has been typically utilized throughout the prior art. The beverage containers of the prior art have typically been of unitary construction, whereas the instant invention utilizes a breakdown assembly for convenience of repair and cleaning, and further enables a combination and positioning of an associated handle at various selective positions relative to the beverage container. Examples of the prior art include U.S. Pat. No. 3,302,427 to Stoner, et al., setting forth a conventional unitary beverage container with a refrigerant within a shell to assist in the maintenance of a predetermined temperature in surrounding relationship relative to the beverage container.

U.S. Pat. No. 3,013, 691 to Prentice sets forth a holder for a beverage container utilizing a unitary insulated rigid wall with projecting radial ribs to position the beverage container relative to the wall interiorly thereof.

U.S. Pat. No. 3,302,428 to Stoner, et al., sets forth a further example of the Stoner assemblage utilizing an interior rib to project and maintain the beverage container spaced from the interior wall surface of the apparatus.

U.S. Pat. No. 4,746,028 to Bagg includes a rigid outer container and resilient inner container to maintain beverages contained therewithin at predetermined temperatures.

U.S. Pat. No. 4,720,023 to Jeff sets forth a further example of a beverage container utilizing an upper deformed angular insulated collar to maintain and position the beverage container within a unitary rigid cup-shaped member.

As such, it may be appreciated that there is a continuing need for a new and improved insulated beverage securement apparatus which addresses both the problems of ease of use and effectiveness of construction, and in this respect, the present invention substantially fulfills this need.

SUMMARY OF THE INVENTION

In view of the foregoing disadvantages inherent in the known types of beverage container apparatus now present in the prior art, the present invention provides an insulated beverage container securement apparatus wherein the same enables selective positioning and securement of a handle member relative to an associated insulated beverage container assembly. As such, the general purpose of the present invention, which will be described subsequently in greater detail, is to provide a new and improved insulated beverage container securement apparatus which has all the advantages of the prior art beverage container apparatus and none of the disadvantages.

To attain this, the present invention includes a transparent, cylindrical sleeve for positioning about a cup-shaped styrofoam-type member for receiving a beverage container therewithin. An upper and lower clamp is secureable about the sleeve, wherein each clamp is formed with a rearwardly extending ear securable to a handle, wherein the handle is provided with upper and lower recessed ribs for receiving the ears on either side thereof below an exterior surface of the handle member. A cup-shaped member is positionable over the sleeve and is provided with a star-shaped opening formed with slits at the apex of each triangular portion of the star-shaped opening to accommodate a beverage container therethrough. A further embodiment includes elongated ears securable relative to one another and maintained in position relative to the beverage container by an elongate link formed with loops at its either end for receiving the ears therethrough. The handle member is securable to terminal ends of the elongate ears.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed described thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to scope of the invention in any way.

It is therefore an object of the present invention to provide a new and improved insulated beverage container securement apparatus which has all the advantages of the prior art beverage container apparatus and none of the disadvantages.

It is another object of the present invention to provide a new and improved insulated beverage container securement apparatus which may be easily and efficiently manufactured and marketed.

It is a further object of the present invention to provide a new and improved insulated beverage container securement apparatus which is of a durable and reliable construction.

An even further object of the present invention is to provide a new and improved insulated beverage container securement apparatus which is susceptible of a low cost of manufacture with regard to both materials and labor, and which accordingly is then susceptible of low prices of sale to the consuming public, thereby making such insulated beverage container securement apparatus ecomomically available to the buying public.

Still yet another object of the present invention is to provide a new and improved insulated beverage container securement apparatus which provides in the apparatuses and methods of the prior art some of the advantages thereof, while simultaneously overcoming some of the disadvantages normally associated therewith.

Still another object of the present invention is to provide a new and improved insulated beverage container securement apparatus wherein the same includes a handle selectively securable relative to an insulated beverage container receiving member for selective securement of the handle relative to the apparatus.

These together with other objects of the invention, along with the various features of novelty which characterize the invention, are pointed out with particularity in the claims annexed to and forming a part of this disclosure. For a better understanding of the invention, its operating advantages and the specific abjects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an isometric illustration of a yet further modifier sleeve member of the instant invention.

FIG. 7 is an isometric illustration of a modified securement clamp and associated link for use in combination with the accordion sleeve, as illustrated in FIG. 6.

FIG. 8 is an orthographic view taken in elevation of the accordion sleeve and modified clamp assembly in an assembled configuration.

DESCRIPTION OF THE PREFERRED EMBODIMENT

Figure 1:
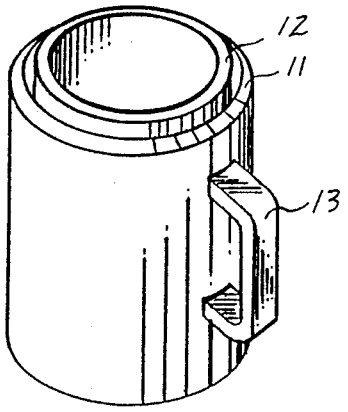
Fig 1 PRIOR ART
FIG. 1 is an isometric illustration of the prior art.

With reference now to the drawings, and in particular to FIGS. 1 to 8 thereof, a new and improved beverage container securement apparatus embodying the principles and concepts of the present invention and generally designated by the reference numeral 10 will be described.

Figure 2:
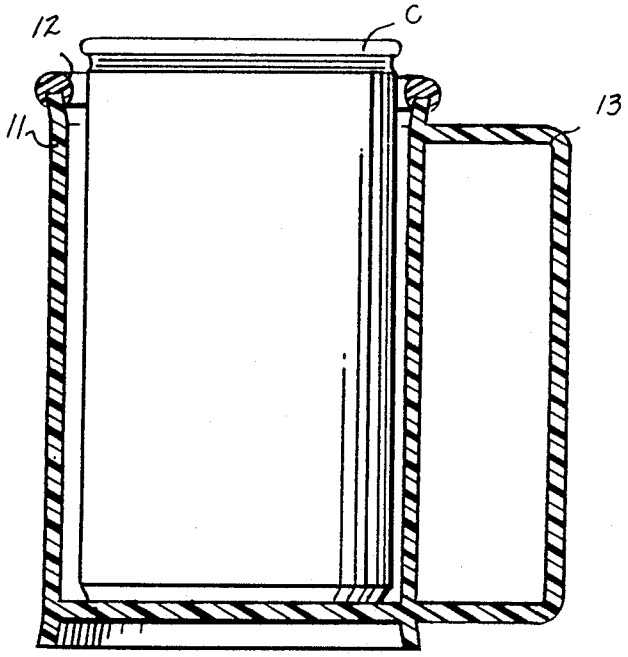
Fig 2 PRIOR ART
FIG. 2 is an orthographic cross-sectional view of the prior art.
Figure 3:
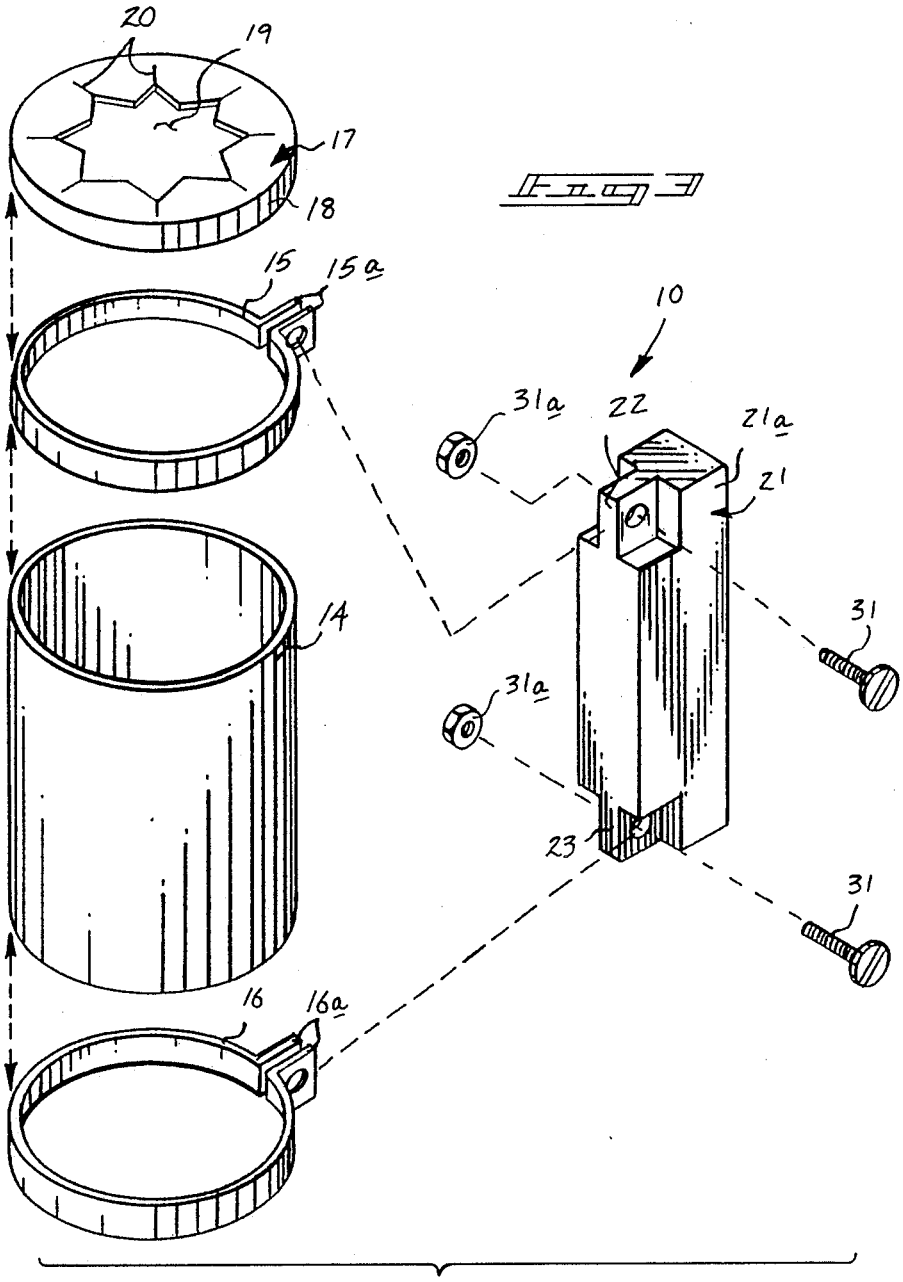
FIG. 3 is an isometric illustration, somewhat expanded, of the instant invention.

More specifically, the insulated beverage container securement apparatus 10 presents an improvement over the prior art, as illustrated in FIGS. 1 and 2, wherein an external rigid cup shell 11 formed with an upper insulative collar 12 and integral handle 13 is formed to receive the beverage container "C" therewithin. FIG. 3 illustrates the invention comprising a semi-rigid cylindrical sleeve 14 for accommodating a conventional sup-shaped styrofoam-type receptable. The sleeve is utilized in combination with a top circumferential clamp 15 and a bottom circumferential clamp 16. Each of the clamps includes a respective pair of top clamp ears **15*a* and bottom clamp ears 16*a*, each including apertures orthogonally extending through the ears for securement to the separate "T" shaped handle member 21. A cap member 17 is positionable and formed with an internal diameter equal to an external diameter defined by the sleeve 14. A star-shaped opening 19 is medially formed through the top planar surface of the cap member 17 with a circumferential skirt 18 depending orthogonally downwardly relative to the top surface for securement about an upper outer surface of the sleeve 14. The star-shaped opening 19 is formed with a series of expansion slits 20 formed at the apex of each triangular portion of the opening 19. The "T" shaped handle member 21 is formed with a support spine 21*a* with a forward rib terminating at each end with a top recessed rib 22 and a bottom recessed rib 23. The recessed ribs each receive on either side thereof respective top and bottom ears 15*a* and 16*a* secured together by use of conventional threaded fasteners 31 and associated nut members 31*a***.

Figure 4:
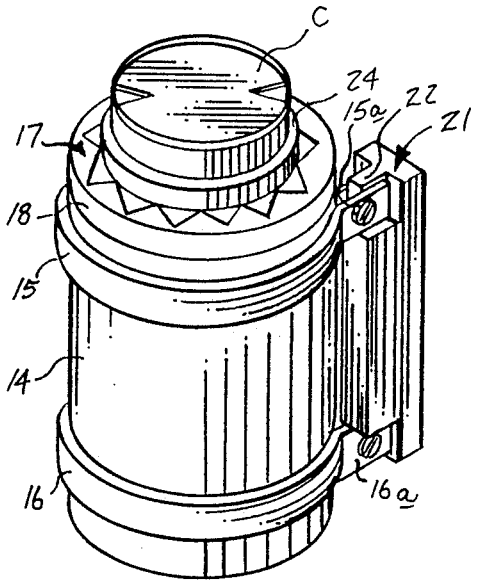
FIG. 4 is an isometric illustration of the instant invention in an assembled configuration.

FIG. 4 illustrates the invention in a similar configuration with the sleeve 14 secured about the styrofoam-type receptacle 24 with a beverage container "C" positioned therewithin. It should be noted the top clamp 15 is spaced above an upper edge of the sleeve 14 a distance at least equal to or greater than the height of the skirt 18 of the cap member 17. Accordingly it should be noted that the length of the handle 21 is less than or equal to a predetermined height of the skirt 14, as illustrated in FIG. 4.

Figure 5:
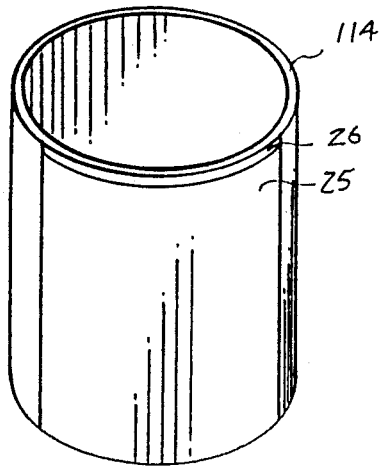
FIG. 5 is an isometric illustration of a modified sleeve of the instant invention.

FIG. 5 illustrates a modified sleeve 114 formed with a transparent layer segment 25 defining a pocket therewithin with an upper slit opening 26 for reception of photographs and identifying sheet-like members that may be conveniently inserted within the pocket for identification in association with the invention of a particular user of the organization.

FIG. 6 illustrates a further modified sleeve 214 formed with a series of accordion pleats 27 to accommodate styrofoam-type receptacles of various diameters. The further modified sleeve 214 is utilized in combination with modified top and bottom clamps 115 and 116. Each of the clamps is formed with respective elongate rearwardly extending ears **115*a* and 116*a* formed with a series of aligned apertures therethrough. An alignment link 28 is formed with a top rectangular loop 29 and a bottom rectangular loop 30 for reception of the top and bottom ears 115*a* and 116*a* therethrough with fasteners and nut members 31 and 31*a* respectively directed through apertures 29*a* and 30*a* formed orthogonally to the top and bottom loops and through the apertures formed within the ears 115*a* and 116*a*. The link enables a combination and alignment of the sleeve relative to various diameters of styrofoam-type receptacles 24. The handle 21 is secured to terminal ends of the elongate ears 115*a* and 116*a*, as illustrated. Further, the spacing of the link 28 relative to the handle 21** enables a modification of the spacing therebetween to adjust the spacing to accommodate various sizes of users' hands therethrough.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beverage container securement apparatus comprising, a sleeve member, and a clamp means for surroundingly securing the sleeve member, and a handle member, said handle member including separate fastener means for securement of said handle member to said clamp means, and further including an insulating cup-shaped receptacle, said cup-shaped receptacle slidingly received within said sleeve member, said sleeve member formed as an elongate cylindrical sleeve formed of semi-rigid material.

2. A beverage container securement apparatus as set forth in claim 1 further including a cap member, said cap member including a downwardly depending skirt defining an internal diameter equal to an external diameter defined by the sleeve member, and wherein said cap member further includes an axially aligned star-shaped opening, wherein said star-shaped opening further includes slits directed radially outwardly of said opening for accommodating a beverage container therethrough.

3. A beverage container securement apparatus as set forth in claim 2 wherein said clamp means comprises a top circumferential clamp and a bottom circumferential clamp, wherein the top clamp includes a first pair of rearwardly extending ears directed exteriorly of the top clamp and the bottom clamp includes a bottom set of rearwardly extending ears extending exteriorly of the bottom clamp, the top and bottom ears each including apertures orthogonally directed and formed to the ears for securement of the respective pairs of ears to the handle member.

4. A beverage container securement apparatus as set forth in claim 3 wherein the handle member is of a generally "T" shaped configuration including an elongate support spine formed with a top recessed rib and a bottom recessed rib for securement of the top ears and bottom ears to the top rib and bottom rib respectively.

5. A beverage container securement apparatus as set forth in claim 4 wherein the handle member is defined by a predetermined length less than a further length defined by said sleeve member.

6. A beverage container securement apparatus as set forth in claim 5 wherein the sleeve member comprises a transparent member and further includes a transparent arcuate segment secured overlying the sleeve defining a pocket between the sleeve and the overlying member.

7. A beverage container securement apparatus as set forth in claim 4 wherein the sleeve member is formed as an elongate accordion pleated member for adjustably receiving the cup-shaped receptacle therewithin.

8. A beverage container securement apparatus as set forth in claim 7 wherein the top pair of ears and the bottom pair of ears each include an aligned series of apertures therethrough, and further including a link member, the link member including a top rectangular loop and a bottom rectangular loop for respectively receiving the top plurality of ears and the bottom plurality of ears therethrough, and the top loop and the bottom loop including a plurality of aligned apertures therethrough for securement of the top loop and the bottom loop to the respective top plurality of ears and bottom plurality of ears.

* * * * *